United States Patent [19]

Stackhouse

[11] 4,300,326

[45] Nov. 17, 1981

[54] STRETCH WRAPPING APPARATUS WITH MECHANICAL CLOSURE

[75] Inventor: William H. Stackhouse, Clarksville, Ind.

[73] Assignee: Lantech Inc., Louisville, Ky.

[21] Appl. No.: 128,873

[22] Filed: Mar. 10, 1980

[51] Int. Cl.[3] ..... B65B 11/04

[52] U.S. Cl. ..... 53/211; 53/587

[58] Field of Search ..... 53/211, 441, 587; 100/15

[56] References Cited

U.S. PATENT DOCUMENTS

| | | | |
|---|---|---|---|
| 2,054,603 | 9/1936 | Leaver | 100/31 |
| 2,088,133 | 7/1937 | Evans | 100/31 |
| 2,124,770 | 7/1938 | Evans | 100/31 |
| 2,330,629 | 9/1943 | Schmidt | 100/31 |
| 2,630,751 | 3/1953 | Cranston et al. | 100/27 |
| 2,716,315 | 8/1955 | Jacoby | 53/98 |
| 2,743,562 | 5/1956 | Dawson et al. | 53/77 |
| 3,003,297 | 10/1961 | Broadhead et al. | 53/198 |
| 3,191,289 | 6/1965 | Fleischer | 29/473.3 |
| 3,207,060 | 9/1965 | Smith | 100/27 |
| 3,309,839 | 3/1967 | Lyon | 53/198 |
| 3,324,789 | 6/1967 | Buettner | 100/27 |
| 3,331,312 | 7/1967 | Leslie et al. | 100/28 |
| 3,412,524 | 11/1968 | Nestell et al. | 53/212 |
| 3,514,920 | 6/1970 | Hoffler et al. | 53/64 |
| 3,549,077 | 12/1970 | Huck | 228/15 |
| 3,590,549 | 7/1971 | Zelnick | 53/30 |
| 3,590,549 | 7/1971 | Zelnick | 53/30 |
| 3,626,654 | 12/1971 | Hoffler et al. | 53/26 |
| 3,788,199 | 1/1974 | Sato et al. | 93/80 |
| 3,793,798 | 2/1974 | Lancaster et al. | 53/30 |
| 3,795,086 | 3/1974 | Hiss | 53/390 |
| 3,820,451 | 6/1974 | Tanaka | 100/4 |
| 3,857,486 | 12/1974 | Kiebanoff | 206/386 |
| 3,863,425 | 2/1975 | Edwards et al. | 53/211 |
| 3,867,806 | 2/1975 | Lancaster et al. | 53/27 |
| 3,986,611 | 10/1976 | Dreher | 206/386 |
| 4,050,220 | 9/1977 | Lancaster et al. | 53/198 R |
| 4,077,179 | 3/1978 | Lancaster et al. | 53/211 X |
| 4,079,565 | 3/1978 | Lancaster et al. | 53/3 |
| 4,204,377 | 5/1980 | Lancaster et al. | 53/587 X |
| 4,232,501 | 11/1980 | Stackhouse | 53/441 X |

*Primary Examiner*—Robert D. Baldwin
*Attorney, Agent, or Firm*—Gipple & Hale

[57] ABSTRACT

A spiral wrapping apparatus provided with a mechanical closure device is used to tie the leading and trailing edges of a film web which have been overwrapped around a plurality of vertically stacked units to form a unitary package. The leading edge of material from the film dispenser is held by a clamp mechanism to a turntable. As the turntable is rotated to wrap the load, the wrapping material is stretched and the trailing end of the material is formed into a rope-like configuration which is carried on the mechanical closure device to a position adjacent the clamped leading end of material with the leading and trailing ends then being tied together. The turntable clamp mechanism releases the leading end of the film web, extends away from the edge of the turntable and clamps the trailing end of the material web behind the tie point at which time the trailing end is severed by a cutter device between the tie point and the clamp mechanism, allowing the tied ends of the wrap to be carried forward toward the wrapped load by the memory of the stretch material seeking its original state. The turntable clamp mechanism then is transported back toward the turntable edge drawing with it the new leading end of material with which to begin the next wrapping cycle.

13 Claims, 15 Drawing Figures

STRETCH WRAPPING APPARATUS WITH MECHANICAL CLOSURE

BACKGROUND OF THE INVENTION

The present invention generally relates to packaging and more particularly to an apparatus for making unitary packages which hold a plurality of components, each package containing a load wrapped in a web of stretched material which is fastened by a mechanical closure device.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,509, and 3,514,920. A discussion of this art is set forth in U.S. Pat. No. 3,867,806.

The present invention provides a simple, reliable and inexpensive method of unitizing multiple unit products into a single wrapped package with an overwrap material which cannot be effectively heat sealed.

When the present apparatus is compared with other apparatus currently used to pack products in corrugated boxes and the cost of the corrugated boxes themselves, the invention shows an enormous cost savings. The invention has comparable costs with kraft wrap but it gives a much tighter and better unitized package than that possible with kraft wrap. In addition to these factors the invention can use stretch film, stretch netting material, or stretch mesh material which provides product visibility not possible with kraft or corrugated wrapping. The netting and mesh incorporates the additional feature of letting the load "breathe." This feature is especially desirable when live produce is packaged and shipped. Furthermore, the present inventive system offers packaging speed, reliability because of the elimination of the package sealing problem and energy savings in that less energy is required to package the product.

A basic problem with shrink and noncling stretch film packaging is that the primary strength and reliability of the package is determined by the consistent quality of the seal. These seals depend on a careful maintenance of the sealing jaw and are never as strong as the film itself. The time taken to make the seals is a limiting factor on the possible speeds of most film packaging systems. Related problems are that some stretchable materials, as for example stretch netting, cannot be heat sealed while narrow film web widths used in spiral wrapping cannot be effectively heat sealed.

In the preferred embodiment the present invention uses a spiral wrapping process to apply the film web to the load.

The use of spiral wrapping machinery to wrap a load is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit an overlapping spiral wrap around the load and returns in the opposite direction to deposit another spiral overwrap around the load. Other spiral wrapping apparatus are described by U.S. Pat. Nos. 3,857,486; 3,788,199; 3,549,017; 3,412,524; 3,191,289; and 2,716,315. The previously indicated patents rely on heat shrink material, adhesives, a heat seal or the tacky nature of the film to hold the outer layer of wrap in a fixed position.

Various other patents have described the use of mechanisms for wrapping loads. In U.S. Pat. No. 3,003,297 a complex cutting and holding mechanism is used to place tape on a box and cut it off with the process being repeated for each box. The unique design and function of the tying, clamping and cutting mechanisms in the present invention does not require a bonding or heating of the film in order for the system to operate.

U.S. Pat. No. 2,088,133 discloses a reverse wrapping wire typing machine. In the reference a gripper mechanism holds a band in position with respect to the load to be wrapped and a rotatable ring drive rotates the band around the load until the band has completed more than one wrap of the load and passes over the body of the gripper mechanism.

A separator slide is used to separate the leading edge of the band from the underlying band and a second gripper mechanism attaches to the separated band. A heat sealing mechanism welds the wrapped layer band to the band underneath it and a cutting mechanism severs the leading edge of the band held by the second gripper mechanism which then becomes the trailing edge of the succeeding wrap. When the band is severed the ring drive mechanism is rotated in a reverse direction for the following load with the various gripping and cutting mechanisms functioning in the same manner.

Additional references of interest which are pertinent to rotatable drives for wrapping packages are disclosed in U.S. Pat. Nos. 3,820,451; 3,331,312; 3,324,789; 3,309,839; 3,207,060; 2,743,562; 2,630,751; 2,330,629; 2,054,603 and 2,124,770.

U.S. Pat. No. 2,124,770 discloses a wrapping apparatus with a clip mechanism for fastening adjacent rope strands. The bundle wrapping machine is automatically operable to wrap a length of rope, or the like, once about a package or bundle, to draw it taut, with its ends in overlapping relation, to apply and cinch one or two metal clips or seals about the overlapped ends to join them permanently together and finally to cut the rope at the outside of the seals thereby to release the bundle. The machine uses paired grippers, one of which is actuated to grip and hold the initial end of the rope during the wrapping operation, while the other is actuated so that it will engage and then grip and hold that portion of the rope that is brought adjacent to the initial end for the clip applying operation. The rope grippers comprise horizontally disposed plungers which extend outwardly to oppose the inward gripping pressure of gripper pressure hooks. As the hooks are pulled inwardly they pull the rope against a sharpened cutting surface of a cutter plate mounted in the end of the top frame. After the clips are applied the rope is cut off outside of the clips to free the bundle with one gripper retaining its hold on the end of the rope leading from the supply, preparatory to a following wrapping operation which will take place in a reverse direction.

Other applications in packaging are shown by U.S. Pat. Nos. 3,514,920 and 3,793,798 in which heat shrink film is wrapped around a pallet supporting a plurality of cartons. A similar full web apparatus using a tensioned cling film is shown by U.S. Pat. No. 3,986,611 while another apparatus using a tacky PVC film is disclosed in U.S. Pat. No. 3,795,086.

The mechanical closure device described in the present specification is a standard "hog ring" type unit such as Model WC6 manufactured by Roto Brand or Model Type I and Type C manufactured by the ATRO Corporation. The slotted pneumatic cylinder used to transport the mechanical closure device is also an off-the-shelf unit available to the public manufactured by the Origa Corporation.

The present invention uses stretchable plastic material in its preferred embodiment since the mechanical stretching of the material utilizes its strength better than heat shrink wrap and can be used on loads where no heat can be applied to the product. The elasticity of the material or film holds the products under more tension than either shrink wrap or kraft wrap particularly with products which settle or relax when packaged.

Various apparatus and processes have been utilized by Lantech, Inc. to use a stretch material in package wrapping. Such apparatus and processes are disclosed in U.S. Pat. Nos. 3,867,806; 4,050,220; 4,077,179; and 4,079,565.

SUMMARY OF THE INVENTION

The present invention generally comprises a novel apparatus for automatically making wrapped unitary packages having an overwrap which is not heat sealed. In the apparatus a series of loads, each containing a plurality of units, are fed onto a turntable adjacent the spiral wrapping apparatus.

The leading end of the material from the dispenser is held by a clamp mechanism of the turntable and the turntable is rotated to wrap the load with material which is stretched as it is wrapped around the load. The material is wrapped around the load and then the trailing end is formed into a rope-like configuration which is carried adjacent the clamped leading end. The leading and trailing ends are then tied together. The clamp mechanism releases the leading end of material, extends away from the turntable, and clamps the trailing end material behind the tie point. The trailing end is then severed between the tie point and the clamp mechanism, and the tied ends are carried toward the wrapped load by the memory of the stretched material seeking its original state. The clamp mechanism then moves back to the turntable, drawing with it the new leading end of material with which to begin the next operation, and the wrapped load is transported off the turntable.

Additional benefits occur in the present invention over the prior art in that no changeover is required in handling random sized units of a variety of materials as the apparatus is constructed to handle such random sized units. Furthermore, the apparatus provides a substantially continuous wrapping operation so that loads can be wrapped at any desired speed and for any time period. A significant economic factor is also present in the present invention as the power requirements are significantly less than those of shrink systems since there is no heat tunnel required and greater speeds of operation are possible because of the elimination of the conventional heat seal which is used in noncling wrapping. Moreover, a wider number of products can be handled by the present invention because of the elimination of the heat seal requirement. In this same regard it should also be noted that adhesives do not work effectively on netting material or narrow band material due to the lack of gripping surface.

Since the present invention does not require a structural seal it can use any type of stretchable material. While the invention is designed to be used with stretch films commonly used in the industry such as low or high density polyethylene, PVC or other suitable films, it can also used suitable plastic netting material such as that known in the trade as "stretch net" manufactured by Bemis Bag.

Because of the simplicity of the construction of the invention there is a greater stability in the inventive wrapping apparatus with less maintenance being required to maintain the apparatus resulting in a corresponding reduction in break-down time. Another desired feature resulting from the apparatus construction is that the invention occupies minimal floor space.

The above-mentioned purposes and operations of the invention are more readily apparent when read in conjunction with the following description of the drawings and the detailed description of the preferred embodiment of the present invention.

DETAILED DESCRIPTION OF THE DRAWINGS

Figure 1:
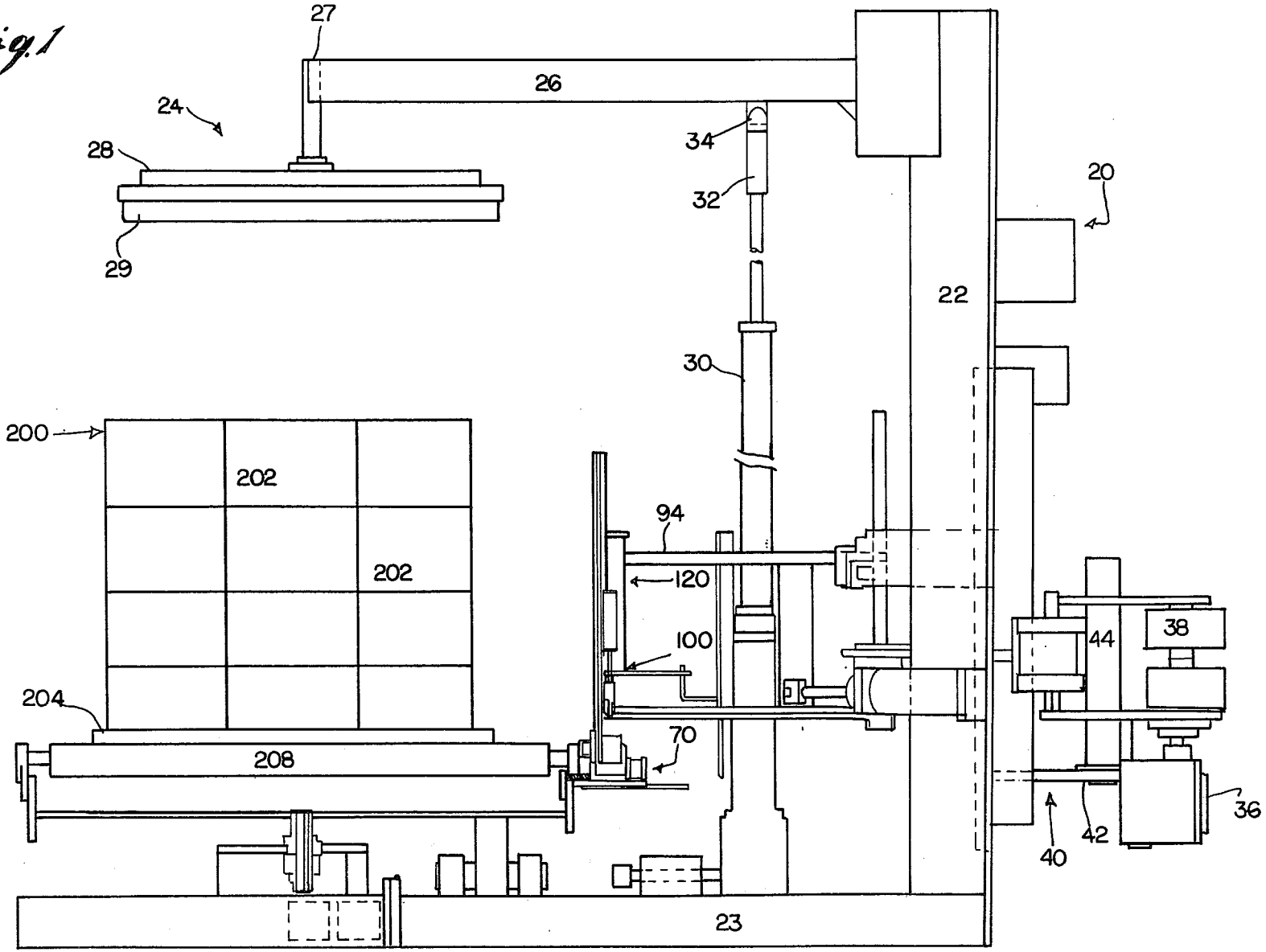
FIG. 1 is a side elevational view of the inventive load wrapping and tying apparatus.
Figure 2:
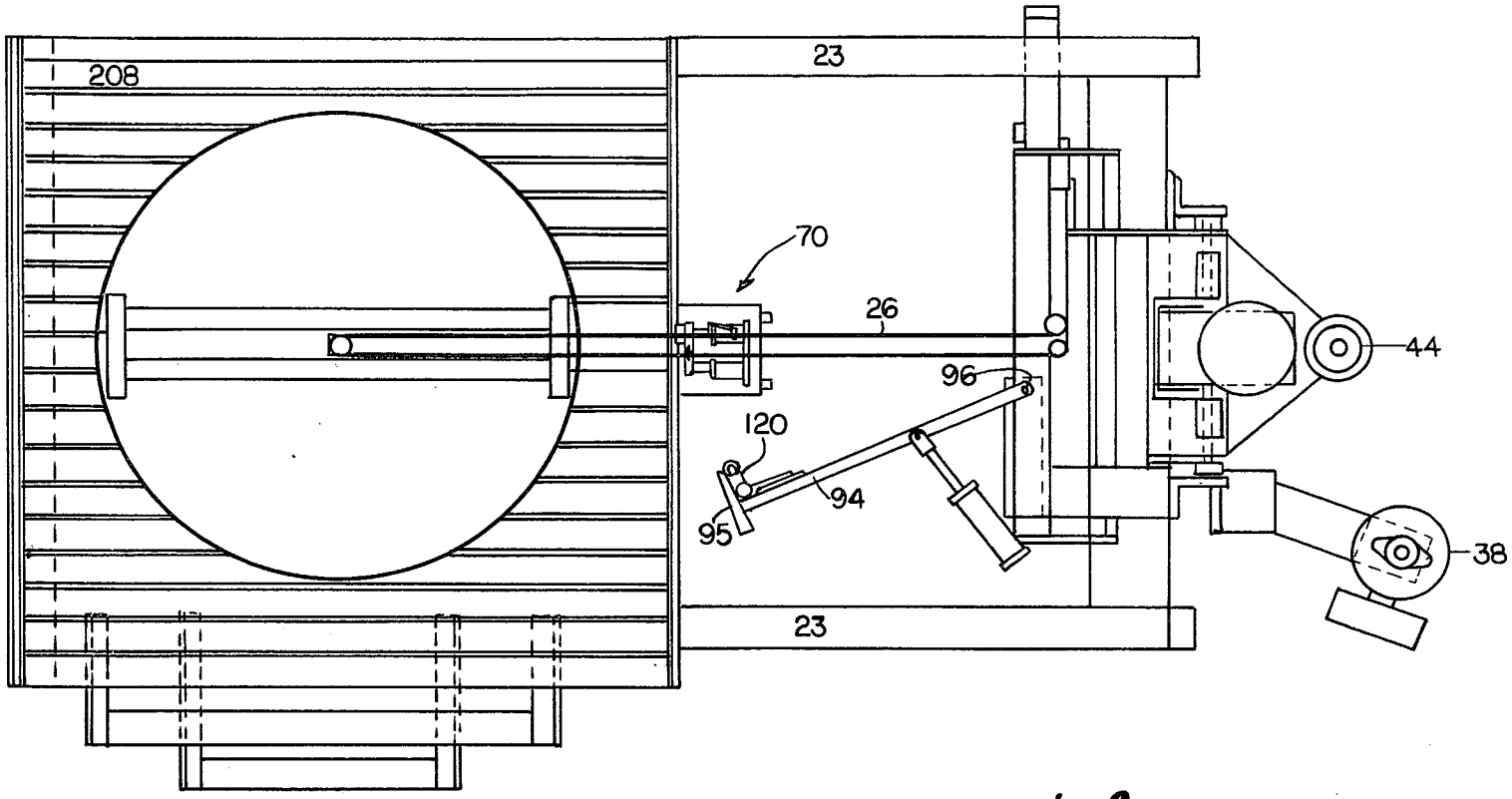
FIG. 2 is a top plan view of the apparatus shown in FIG. 1.

The best mode of the wrapping and tying apparatus 20 is shown in FIGS. 1 through 6 with operation of the apparatus and its respective component parts being schematically shown in FIGS. 7 through 14.

The wrapping and tying apparatus 20 is mounted on an upright frame 22 sitting on a base 23. A platen assembly 24 is mounted on the frame 22 for movement along the frame. The platen assembly comprises a support structure 26 moveably mounted to the frame and a platen 28 moveably mounted to the support structure. A pneumatic cylinder 30 is mounted to the base 23 with its piston rod 32 mounted to the platen support structure 26 by means of a bracket and pin assembly 34. Thus the platen can be raised or lowered manually by an operator or an automatic sequence during the wrapping stages of the load. The platen has a flexible lower surface 29 which is adapted to be placed on top of a load 200, comprising a plurality of unitary members 202 stacked on a pallet 204. The lower surface 29 of the platen is lowered onto the top of the load 200 after the load is carried by a power conveyor (not shown) onto turntable 208.

When the turntable 208 rotates the platen rotates within a journal 27 of the platen assembly holding the units in position on the load as a spiral material wrap is stretched wrapped around the load. The platen provides a force on the units 202 to prevent the units from being displaced or pulled from the load as the stretched material is wrapped around the load.

A film roll support 40 is mounted on the frame 22. The film roll support includes a platform 42 and a film roll mandrel or vertical holding member 44 mounted on the platform 42. The mandrel 44 holds a roll of film 50 of either a solid web material or of a netting material. The platform or carriage 42 is driven up the frame by a rack and pinion assembly chain, screw drive or other suitable means which is well known in the art. The film roll carriage can be mounted in guides or tracks in the frame and is preferably driven by the previously described rack and pinion drive.

The film roll 50 is restricted by the action of a magnetic particle brake 36 which applies a restrictive force on the film roll subjecting the material to a braking force causing it to stretch as it is wrapped around the load. The restrictive force is preferably applied by utilizing a roller assembly 38 as shown in FIG. 1 to engage the outside of the film roll and apply a constant force on the film roll uniformly stretching the film web as it leaves the roll 50.

Typical films which can be used in the stretch wrapping apparatus are EVA copolymer films with a high EVA content, such as the film manufactured by Consolidated Thermoplastics, "RS-50", Bemis "Super-Tough" and PPD "Stay-Tight" films. PVC films such as Borden Resonite PS-26 can be used in the invention along with premium films such as Mobil-X, Presto Premium and St. Regis which utilize a new low pressure polymerization process resin manufactured by Union Carbide and Dow/Corning Chemical Company. This resin, called linear low density polyethylene, has significantly different stretch strength characteristics than previous stretch films. These characteristics allow the film to withstand the high stress of extreme elongation without tearing during wrapping of the pallet.

It should be noted that film, film material, film web and netting are used interchangeably throughout the specification.

The leading end of the material web is roped as will be more fully disclosed and when roped, is held by a clamp assembly 70 mounted to the edge of the turntable. The clamp assembly 70 is best shown in FIGS. 3 and 4.

The clamp assembly 70 comprises a support block 80, a rotatable spacer arm 72 and rotatable clamps 74 and 75 respectively mounted to shafts 76 and 77. The shafts 76 and 77 are rotated by respective rotary pneumatic cylinders 78 and 79. The pneumatic cylinders 78 and 79 are secured to the top horizontal surface of support block 80 so that clamps 74 and 75 and spacer arm 72 which is mounted to shaft 76 will be rotated in a plane substantially perpendicular to the horizontal surface of support block 80. Support block 80 is preferably slidably mounted on clamp assembly mount 82 but it can be pivotally mounted in an alternate embodiment. The clamp assembly mount 82 is secured to the underside of turntable 208, so that the clamp assembly 70 may be transported in a horizontal plane toward or away from the edge of turntable 208 by a clamp assembly extension drive 84 secured to the underside of turntable 208. A cutter frame 88 is secured to the frontal side of clamp 74 and is constructed to hold the film web while the cutter blade of the cutter device severs the film web. The clamp assembly extension drive 84 comprising a pneumatic cylinder secured to the turntable and a piston rod secured to the support block 80 moves the clamp assembly toward and away from the turntable. The cylinder acts against a coil spring 86 with one end secured to cylinder seat 81. The coil spring constantly urges the support block toward the turntable.

Figure 3:
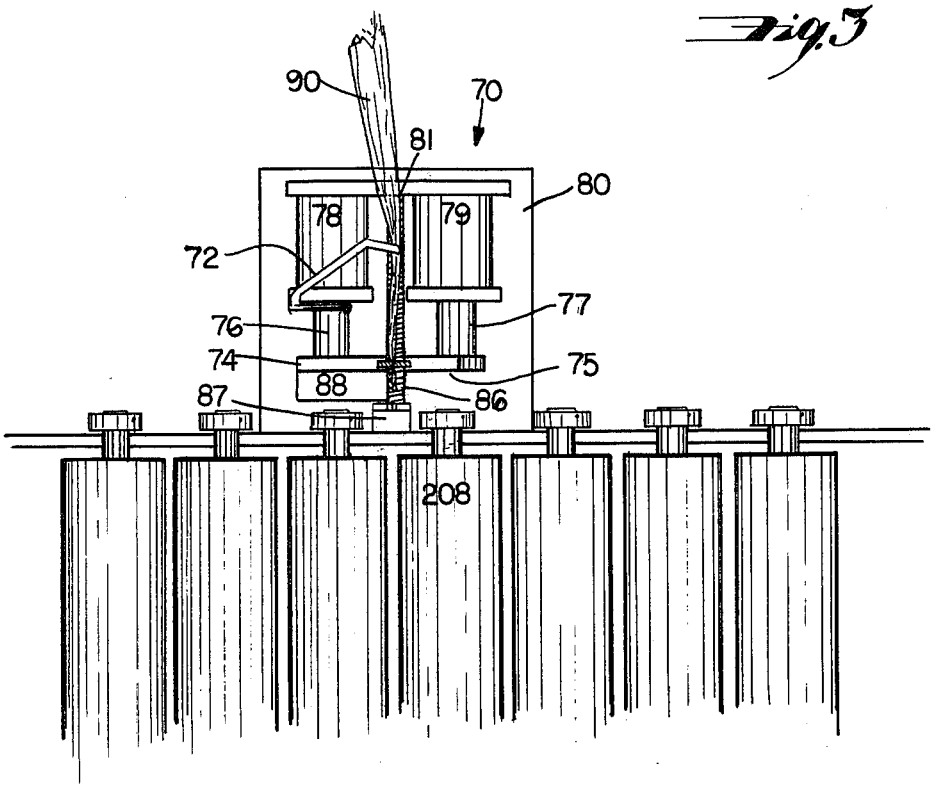
FIG. 3 is an enlarged partial top plan view of the clamping assembly used in the inventive apparatus.
Figure 4:
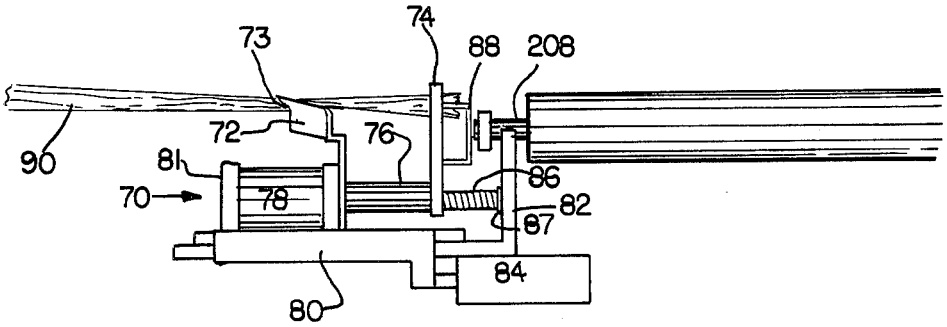
FIG. 4 is a side elevational view of the clamping assembly shown in FIG. 3.

As shown in FIGS. 3 and 4, the leading end 90 of the film web is compressed into a rope configuration and held between clamps 74 and 75 prior to rotation of the turntable 208. The clamps 74 and 75 and the spacer arm 72 are spaced apart, and the roped leading end 90 of the film web passes through cut out 73 defined by one end of the spacer arm 72. The other end of spacer arm 72 is attached to shaft 76 so that when clamps 74 and 75 are opened by rotation of shafts 76 and 78, spacer arm 72 will also rotate and release the roped web.

Figure 15:
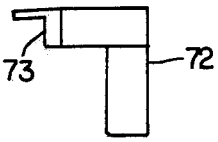
FIG. 15 is a side elevational view of the spacer arm.

FIG. 15 is an isolated side view of spacer arm 72, most clearly showing cut out 73 through which the leading end 90 passes. As is best shown in FIGS. 7 through 10, the spacer arm 72 holds the leading edge of the film web 90 away from the clamps 74 and 75 and load 200 when the load 200 is rotated by turntable 208. Film is pulled from the web roll 50 by rotation of the turntable thereby wrapping the load 200. When rotation is finished and the clamp assembly 70 is at rest adjacent to the gathering cutter assembly arm 94, the arm 94 pivots on rod 96 mounted to frame 22 toward the clamps 74 and 75. The free end 95 of arm 94 engages and draws the trailing film web 92 toward the clamps 74 and 75 and, as shown in FIG. 11, the arm 94 comes to rest with end 95 directly above the roped web extending between clamps 74 and 75 and spacer arm 72.

Figure 5:
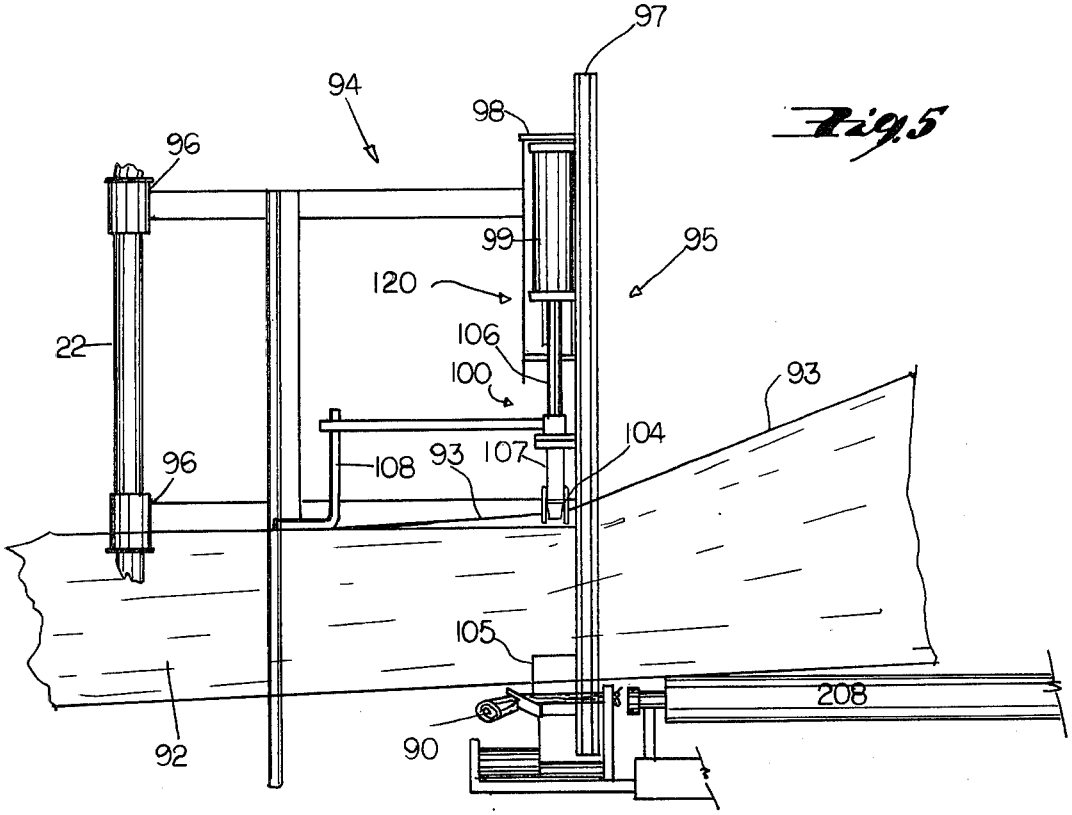
FIG. 5 is a side elevational view of the gathering cutter assembly arm and the clamping assembly, with the trailing film web partly roped above the clamping assembly.
Figure 6:
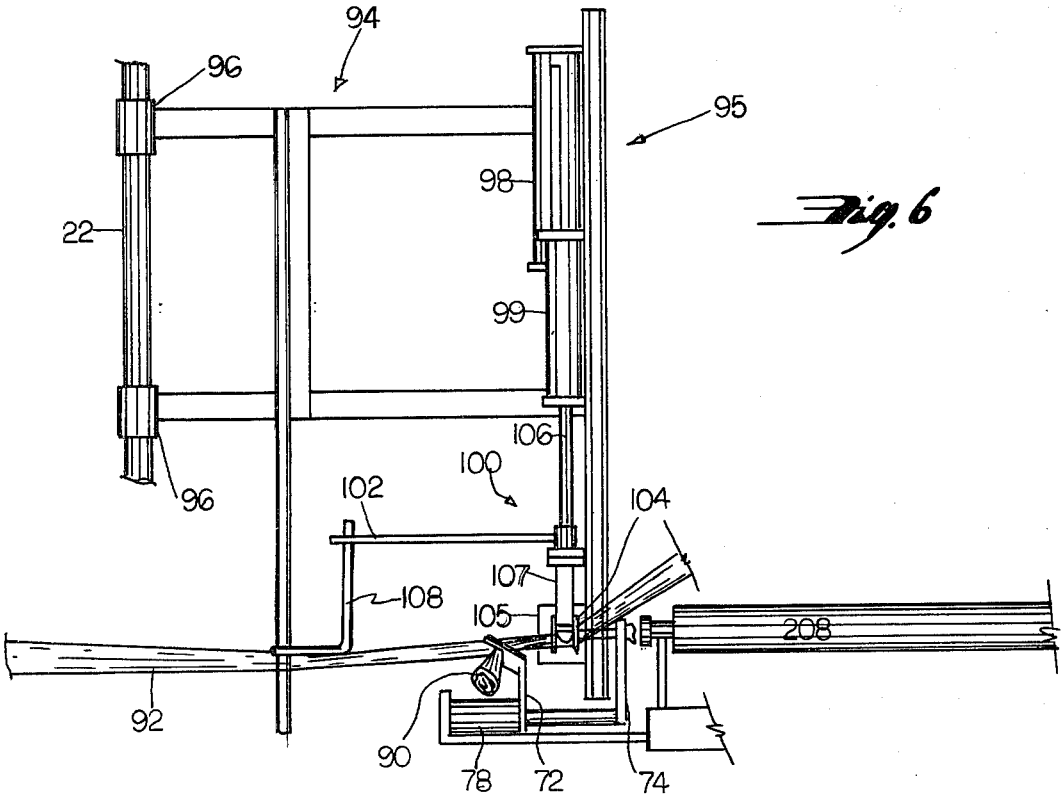
FIG. 6 is a side elevational view of the gathering assembly arm and the clamping assembly, with the trailing film web roped adjacent the clamping assembly.
Figure 7:
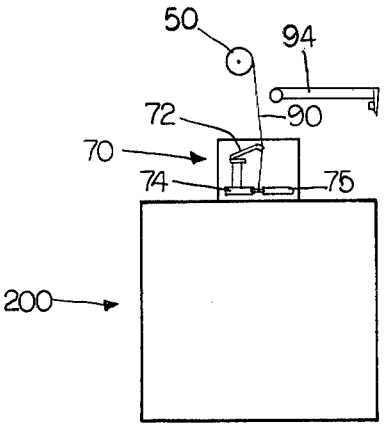
FIG. 7 is a schematic plan view of the leading end of the web roped and held in the clamping assembly before wrapping of the load.
Figure 8:
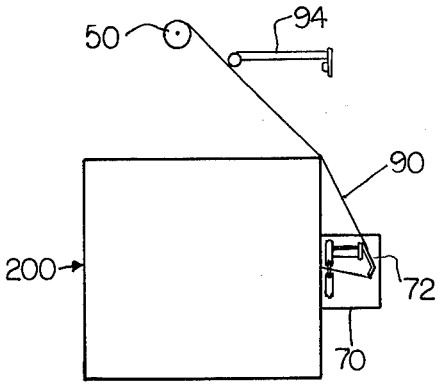
FIG. 8 is a sequential schematic plan view of the load shown in FIG. 7 with the turntable rotated approximately one quarter turn.
Figure 11:
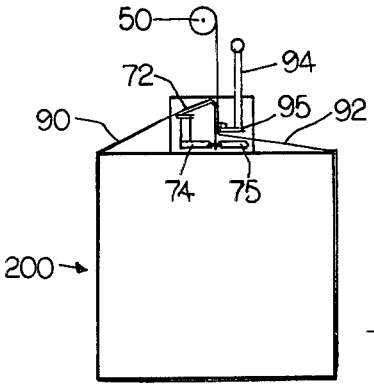
FIG. 11 is a sequential schematic plan view of the apparatus shown in FIG. 10 in which the gathering cutter housing arm has positioned the roped trailing end of the web in alignment with the roped leading end of the web between the clamps and the spacer arm.

As shown in FIGS. 5 and 6, the web collapsing and tying mechanism 120 and cutter device 105 is mounted on end 95 and collapses the trailing film web 92 when positioned as shown in FIG. 11. The web collapsing and tying mechanism 120 comprises a slotted "Origa" pneumatic cylinder 98, having a moveable ear extending therefrom which is secured to and transports pneumatic cylinder 99, its associated piston rod 106 and the film gathering assembly 100 attached to the lower end of piston rod 106 in a vertical direction. The film web gathering assembly 100 comprises a notched closure plate 104 secured to the tying assembly or hog ringer 107 which is in turn mounted to the end of piston rod 106. The cutter device 105 is mounted on the other side of the tying assembly to arm end 95 and comprises a pneumatic cylinder, piston rod and cutting blade secured to the end of the cutting rod. The cutter cylinder when activated extends the piston rod horizontally so that the blade guillotines the collapsed web across its side securing the collapsed web. A rear extension bar 102 is attached perpendicular to piston rod 106, and rear film compression bar 108 secured at a right angle to the rear extension bar is positioned upstream from cutter device 105. The closure mechanism 104 and cutter device 105 are powered by action of the respectively identified pneumatic cylinders. The rear compression bar 108 is substantially "L" shaped and formed so that its lower leg is substantially the same height as closure plate 104, and is substantially horizontal and perpendicular to the upper edge 93 of the film web extending between the free end 95 of the arm 94 and the film roll 50.

After the free end 95 of arm 94 comes to rest adjacent clamps 74 and 75, the film gathering assembly 100 is moved downward by the action of cylinder 98 carrying linear pneumatic cylinder 99 and piston arm 106. The closure mechanism 104 engages the top edge 93 of the trailing web 92 and collapses the trailing web 92 into a roped configuration between the clamps 74 and 75 and the spacer arm. The rear compression bar 108 also meets the top edge 93 of the film web and collapses the trailing web 92 to provide a roped configuration upstream from closure device 104. When the web is completely collapsed so that it is adjacent to the web extending between clamps 74 and 75 and spacer arm 72, the hog ringer 107 ties the adjacent roped webs together at point 110.

Figure 12:
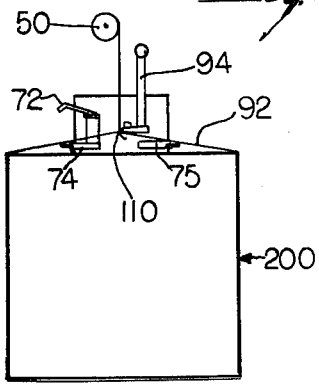
FIG. 12 is a sequential schematic plan view of the apparatus shown in FIG. 11 in which the leading end of the web is tied to the trailing end of the web and the clamps and the spacer arm have released the leading end of the web.
Figure 13:
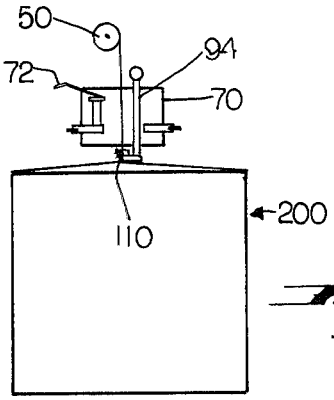
FIG. 13 is a sequential schematic plan view of the apparatus shown in FIG. 12 in which the clamps and the spacer arm have moved away from the turntable along the line of the trailing end of the web.
Figure 14:
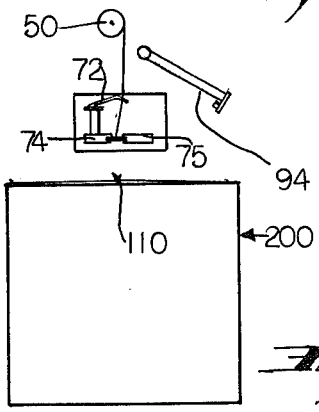
FIG. 14 is a sequential schematic plan view of the apparatus shown in FIG. 13 in which the clamps and the spacer arm close on the trailing end of the web, with the trailing end being cut behind the tie point so that the tied ends return to their memory position against the load and the gathering cutter housing pivots out from the turntable.

As shown in FIGS. 12 through 14, rotary pneumatic cylinders 78 and 79 rotate in opposite directions after the roped film webs are tied together at point 110. Clamps 74 and 75 are moved in opposite directions by the rotation of cylinders 78 and 79, thereby freeing the leading end 90 of the film web. Spacer arm 72 is also simultaneously rotated by cylinder 78. The roped webs are tied together and held in place by the hog ringer until the clamp assembly 70 is moved into position and secures the leading end for the next load. The clamp assembly 70 is moved away from the load 200 and the cylinders 78 and 79 are rotated to bring clamps 74 and 75 together again between point 110 and the feed roll 50, thereby clamping trailing end 92 of the web. The tie point 110 may then return to its memory position against the load 200 without obstructions as will be discussed more fully later in the disclosure. Spacer arm 72 is also rotated and the cut out 73 engages the trailing web 92. The cutter device 105 is reciprocated cutting the roped webs between point 110 and clamps 74 and 75, and the roped webs return to their memory position against the load 200.

At this stage the wrapping of the load 200 is completed. The load 200 may be carried from turntable 208 and replaced with an unwrapped load. Clamp assembly 70 is moved back to the turntable 208, drawing with it the trailing web 92 which becomes leading edge 90 for the next wrapping cycle. The gathering cutter arm 94 pivots away from the clamp assembly 70 and slotted pneumatic cylinder 98 withdraws the web collapsing and typing mechanism 120 to its original position.

Figure 9:
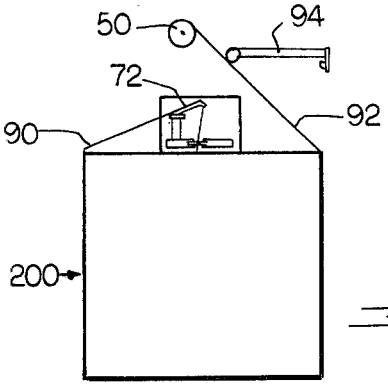
FIG. 9 is a sequential schematic plan view of the apparatus shown in FIG. 7 with the turntable rotated one full turn.
Figure 10:
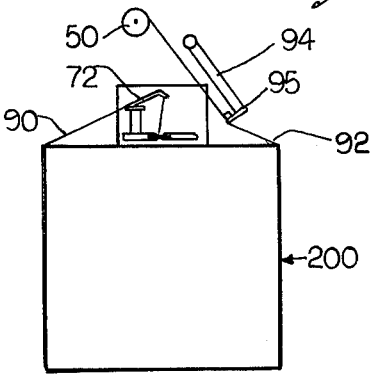
FIG. 10 is a sequential schematic plan view of the apparatus shown in FIG. 9 showing the gathering cutter housing arm pivoting to overlay the trailing web on the roped leading end of the web.

The operation of the apparatus is best shown in FIGS. 7 through 14 which shows the sequential steps of the apparatus in a wrapping cycle. In the beginning of the wrap cycle, a load 200 is transported onto the turntable 208 by a powered loading conveyor and is positioned for wrapping. The leading edge 90 of the film web is withdrawn from the film roll 50 collapsed and held in position by clamps 74 and 75 adjacent to the load. The spacer bar 72 engages the film web at the same time that the clamps are closed so that the film web will be held away from the load during the wrap. The turntable is then activated and the load is spirally wrapped by depositing a stretched film web a predetermined number of times around the load. At the end of the wrap cycle the load is stopped as is shown in FIG. 9 and the gathering cutter arm 94 is pivoted inward as shown in FIG. 10 carrying the trailing end of the film 92 into a position adjacent that to the leading edge 90 as shown in FIG. 11. The closure or tying mechanism is activated with the web being collapsed by a notched guide plate mounted on the closure mechanism as it travels downward until the collapsed web is positioned adjacent the collapsed leading edge of the film. The tying mechanism or hog ringer then ties the leading and trailing edges together with a clamp or staple which is closed around the ends. Clamps 74 and 75 then open releasing the leading edge and the clamp assembly is withdrawn away from the turntable to a position between the closure mechanism and film roll. The clamp assembly is again activated and clamps 74 and 75 clamp and securely hold the collapsed roped trailing edge and the spacer bar 72 engages the collapsed film web. The cutter device is reciprocated horizontally cutting the roped trailing edge between the clamp point and the tie to sever the wrap from the dispenser roll 50. The film having been previously stretched assumes its original memory position and is carried against the load and is pulled inside the wrap by the force on the film caused by the initial turntable revolution at the start of the wrap cycle. This initial turntable revolution has previously induced significant vertical force on the film web as the roll carriage began a rapid vertical ascent starting the spiral wrap. The vertical force pulls the tied portion back inside the film wrap so that the tie is covered by an outside layer of film, thus presenting a smooth external surface. Load 200 is then transported off the conveyor by take off rollers and the clamp assembly moves back into its initial starting position carrying the trailing edge which becomes the new leading edge for the next load. A new unwrapped load is carried on to turntable to begin the start of the wrapping of the load.

It should be noted that the steps of the wrapping process can be interchanged without departing from the scope of the invention. Furthermore, these steps can be interchanged and are equivalent.

In the foregoing description, the invention has been described with reference to a particular preferred embodiment although it is to be understood that the specific details shown are merely illustrative and that the invention may be carried out in other ways without departing from the true spirit and scope of the following claims.

What is claimed is:

1. An apparatus for making a package comprising a frame, a carriage mounted on said frame, said carriage being adapted to hold a roll of material for rotation, a turntable adapted to support a load positioned adjacent said frame, drive means connected to said turntable and adapted to rotate said turntable and an associated load mounted on said turntable to cause a web of material to be pulled from the roll held by said carriage to overwrap said load, tensioning means adapted to tension said web of material as it is transferred to said load, clamp means mounted to said turntable, said clamp means being movable to and from said turntable to clamp said material web in two positions adjacent to said load, the first clamping position clamping the leading end of material through a wrap cycle until the trailing end of material is fastened to the leading end, the second clamping position clamping the leading end of material of the succeeding wrap before the completion of the entire wrap cycle, collapsing means moveably mounted adjacent the material path, said collapsing means moving into the material path carrying said trailing end adjacent a leading end of the material, and collapsing a trailing end of said material into a rope-like configuration, cutter means and fastening means mounted adjacent said collapsing means, said fastening means comprising an assembly for fastening the trailing end of the material web to the leading end of the material web and said cutter means adapted to sever said material web from said material roll.

2. An apparatus as claimed in claim 1 wherein said collapsing means includes a notched plate mounted to said tying means.

3. An apparatus as claimed in claim 1 wherein said brake means comprises a roller assembly and a particle brake operatively connected to said roller assembly causing said roller assembly to apply restrictive force on the exterior of said material roll to uniformly stretch said material.

4. An apparatus as claimed in claim 1 wherein said fastening means comprises a tying assembly mounted to a gathering arm assembly which is pivotally mounted to said frame, said tying assembly being constructed to engage and tie said leading and trailing ends of material.

5. An apparatus as claimed in claim 4 wherein said tying assembly is a hog ringer.

6. An apparatus as claimed in claim 1 wherein said turntable clamp means comprises a moveable support member, cylinder means mounted to said support member, a clamp member operatively connected to and moved by said cylinder means into and out of positions of engagement, and means to transport said support member away from and toward said turntable.

7. An apparatus as claimed in claim 6 wherein said transporting means comprises a fluid cylinder mounted to said turntable and secured to said support member, and spring means connected to said support member and said turntable.

8. An apparatus as claimed in claim 7 wherein said spring means is a coil spring biased to pull said support member toward said turntable.

9. An apparatus as claimed in claim 1 wherein said cutter means comprises a fluid cylinder connected to said frame and a knife mounted to said cylinder, said knife being activated by said cylinder which drives said knife against the collapsed web of material to sever said material.

10. An apparatus for making a package comprising a frame, a carriage mounted on said frame, said carriage being adapted to hold a roll of stretchable material for rotation, a turntable adapted to support a load positioned adjacent said frame, drive means connected to said turntable and adapted to rotate said turntable and an associated load mounted on said turntable to cause a web of material to be pulled from a roll of stretchable material held by said carriage to overwrap said load, stretching means connected to said carriage, said stretching means being adapted to control movement of the web of material from said roll so that said web is stretched as it is transferred to said load, clamp means movably mounted to said turntable, said clamp means being adapted to clamp said material web and hold said web in a first position spaced apart from said load while stretched material is wrapped around said load and in a second position located a greater distance from said load than said first position after stretched material has been wrapped around said load, collapsing means moveably mounted adjacent the material path, said collapsing means moving into the material path carrying said trailing end adjacent a leading end of the material, and collapsing a trailing end of said material into a rope-like configuration, cutter means and fastening means mounted adjacent said collapsing means, and fastening means comprising an assembly for fastening the trailing end of the material web to the leading end of the material web by placing a material tie around said two adjacent material webs to hold them together and said cutter means positioned between said tie point and said roll of material to sever said material web from said material roll.

11. An apparatus for making a unitary package of a load consisting of a plurality of stacked units comprising a vertical frame, a carriage mounted on said frame, said carriage adapted to hold a roll of stretchable material for rotation, material stretching means connected to said carriage to restrict said material being dispensed from said material roll and to stretch the same, a turntable adapted to support a load positioned adjacent to said frame, turntable clamp means moveably mounted to said turntable and adapted to clamp the leading end of said stretchable material, transport means mounted to said turntable and connected to said clamp means, said transport means being adapted to transport said clamp means a predetermined distance away from and toward said turntable, drive means connected to said turntable and adapted to rotate said turntable and an associated load placed on said turntable causing stretched material from said roll of material held by said carriage to overwrap said load, cutting and tying means moveably mounted to engage said stretched material and carry it adjacent the material held in the turntable clamp, and material collapsing means adapted to collapse said stretched material, said tying means tying said stretched material, and said cutting means severing said material from said material roll at a point upstream from the tie point.

12. An apparatus as claimed in claim 11 wherein said clamp means comprises a base member moveably mounted to said turntable, at least a pair of rotary pneumatic cylinders mounted to said base member and rotatable clamps mounted to each of said rotatable cylinders and adapted to be rotatably driven by said cylinder to engage said rotatable clamps in a clamping position.

13. An apparatus for making a unitary wrapped package comprising a frame, a carriage mounted on said frame, said carriage adapted to hold a roll of stretchable material for rotation, material stretching means engaging said material to stretch said material being dispensed from the film roll, a turntable adapted to support a load positioned adjacent said frame, rotatable turntable clamp means moveably mounted to said turntable, means to move said turntable clamp means away from and toward said turntable side, means positioned upstream from said turntable clamp means to collapse said material into a collapsed roped condition, said turntable clamp means holding the leading end of said material in a collapsed roped condition and spaced apart from said load in a fixed position, fastening means moveably mounted adjacent said material path adapted to collapse the trailing end of said material and carry said collapsed material into a position so that said trailing end of the material is positioned adjacent said leading end of the material, said fastening means being provided with means to engage a material clip around said leading and trailing ends and hold said leading and trailing ends in a fixed position, and cutting means to severe said material between said tied area and material roll.

* * * * *